United States Patent [19]

Richey

[11] Patent Number: 4,949,958

[45] Date of Patent: Aug. 21, 1990

[54] WEIGHT LIFTING MACHINE

[76] Inventor: Michael L. Richey, 1305 Wigwam, Kokomo, Ind. 46902

[21] Appl. No.: 300,032

[22] Filed: Jan. 23, 1989

[51] Int. Cl.[5] ..... A63B 21/00

[52] U.S. Cl. ..... 272/120; 272/134; 272/DIG. 4

[58] Field of Search ..... 272/93, 116, 120, 134, 272/144, 117, DIG. 4; 128/25.2

[56] References Cited

U.S. PATENT DOCUMENTS

| | | | |
|---|---|---|---|
| 232,217 | 9/1880 | Tuttle . | |
| 2,472,391 | 6/1949 | Albizu . | |
| 2,733,922 | 2/1956 | Diego . | |
| 2,783,045 | 2/1957 | Bosch . | |
| 2,920,890 | 1/1960 | Nawara . | |
| 3,219,341 | 11/1965 | Weinstein . | |
| 3,380,737 | 4/1968 | Elia et al. | 272/120 X |
| 3,984,101 | 10/1976 | Garza . | |
| 4,211,403 | 7/1980 | Coffaro et al. | 272/134 |
| 4,248,420 | 2/1981 | Hayes . | |
| 4,252,314 | 2/1981 | Ceppo . | |
| 4,272,074 | 6/1981 | Sferle . | |
| 4,383,684 | 5/1983 | Schleip . | |
| 4,468,025 | 8/1984 | Sferle . | |
| 4,632,390 | 12/1986 | Richey . | |
| 4,725,057 | 2/1988 | Shifferau | 272/134 X |
| 4,746,114 | 5/1988 | Grider | 272/134 X |
| 4,757,991 | 7/1988 | Maag | 272/134 |

FOREIGN PATENT DOCUMENTS 376602 4/1907 France .

OTHER PUBLICATIONS

"Exercenter Home Gym", The Shelburne Company Catalog, Winter/Holiday 1983, at p. 25.

*Primary Examiner*—Richard J. Apley
*Assistant Examiner*—H. N. Flaxman
*Attorney, Agent, or Firm*—Ice Miller Donadio & Ryan

[57] ABSTRACT

A weight lifting exercising device of the type wherein at least a portion of the weight lifted includes the user's own weight is disclosed. The device includes a frame having a first end and a second end. A platform has a first end and a second end, with the second end of the platform being pivotally mounted adjacent to the second end of the frame to permit the first end of the platform to move in a generally vertical arc. A bench has a first end, a second end, an upper surface and a lower surface. The first end of the bench is pivotally mounted to the frame adjacent to the first end of the bench to move in a generally vertical arc during the operation of the device. A carriage is disposed below the bench for supporting the second end of the bench on the platform. A first exercise bar is also provided. A first flexible cable has a first end, a second end and a middle portion. The first end of the cable is coupled to the first exercise bar, the second end of the cable includes a coupler for coupling the second end to a member on the device disposed at a level generally no higher than the upper surface of the bench.

18 Claims, 4 Drawing Sheets

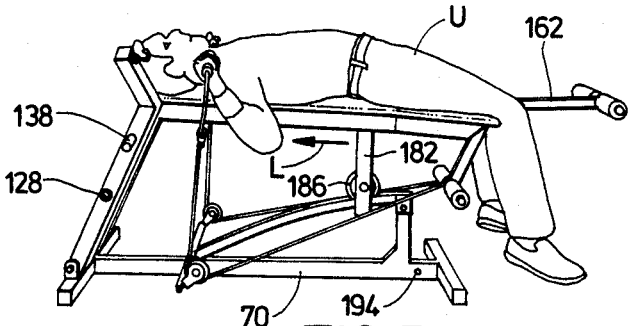
FIG.5
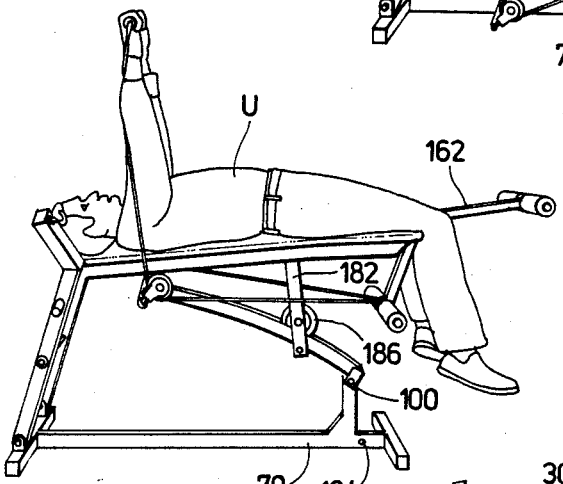
FIG.6
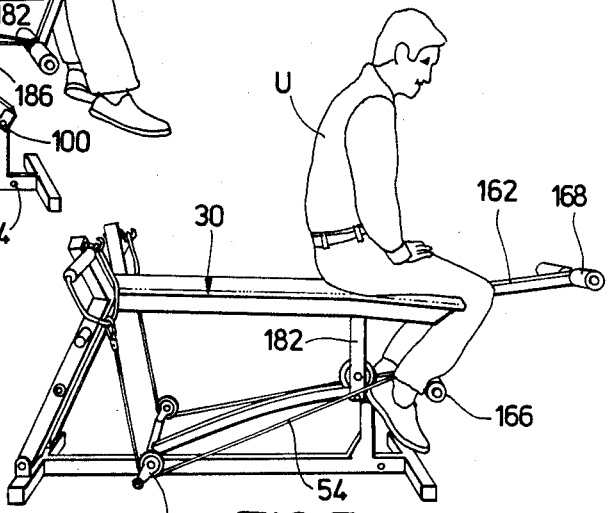
FIG.7
FIG.8
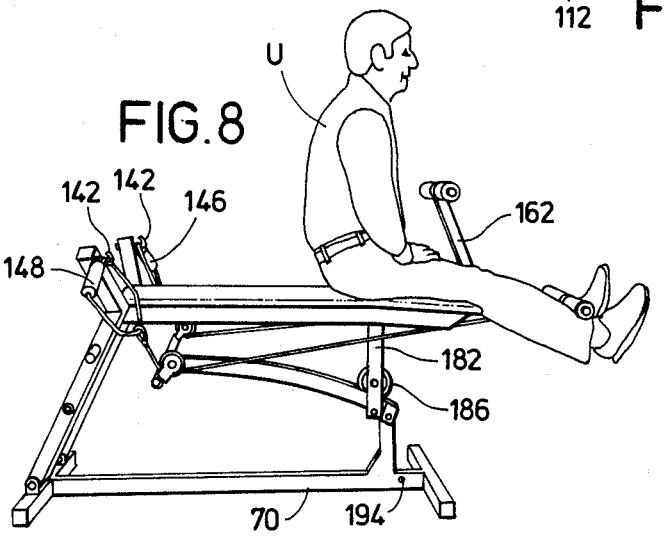

WEIGHT LIFTING MACHINE

BACKGROUND OF THE INVENTION

The present invention relates to an exercising device, and more particularly to a weight lifting type of exercising device.

For many years, persons have lifted weights to strengthen muscles and improve their physical condition. In order to facilitate weight lifting exercises, a weight lifting device is often employed.

The most common form of weight lifting device is probably the barbell and weight set. A barbell comprises a generally cylindrical bar, to which one or more doughnut-shaped, external weights are applied. The user can vary the weight lifted by varying the number and size of the weights attached to the barbell.

As will be appreciated, several disadvantages exist with the use of externally applied weights. One disadvantage is the cost associated with the purchase of the externally applied weights. A second disadvantage relates to the safety of such devices. Many weight lifting exercises require lifting the weighted barbell to a position above the body of the user. If the user is unable to control the weight so lifted above his body, and if the barbell were to fall, a likelihood exists that the barbell would fall upon the body of the user, thus injuring the user.

To overcome these difficulties (and others) associated with externally applied weights, the applicant invented the weight lifting machine disclosed in RICHEY U.S. Pat. No. 4,632,390. The device disclosed in the RICHEY Patent represents a substantial improvement over then prior art devices, by providing a weight lifting device which does not require the use of externally applied weights. Rather than lifting externally applied weights, the weight lifted by a person using the RICHEY device primarily comprises the user's own body weight. As body strength is generally proportional to body size (and hence weight), the applicant found that the device disclosed in the '390 Patent provided a most satisfactory means of lifting weights for users having a wide range of physical size and strength.

Although the device disclosed in the '390 Patent performs its intended function in a most satisfactory manner, room for improvement exists. One area in which room for improvement exists relates to the relative complexity and number of parts of the device shown in the '390 Patent. As can be appreciated, a less complex device with fewer moving parts can probably be manufactured less expensively, and hence sold less expensively than a more complex device with a greater number of parts. Further, a reduction in the number of parts can often improve the reliability of the device, as less parts exist which can be mis-manufactured, break down, or wear out.

It is therefore one object of the present invention to provide a weight lifting exercise ice of a type wherein at least a portion of the weight lifted includes the user's own weight, which is less complex, and requires fewer parts than prior, known devices.

SUMMARY OF THE INVENTION

In accordance with the present invention, a weight lifting exercising device of the type wherein at least a portion of the weight lifted includes the user—s own weight is provided. The device includes a frame means having a first end and a second end. A platform means is also included which has a first end and a second end, with the second end of the platform means being pivotally mounted adjacent to the second end of the frame means to permit the first end of a platform means to move in a generally vertical arc during the operation of the device. A bench means is included which has a first end, a second end, an upper surface and a lower surface. The first end of the bench means is pivotally mounted to the frame means adjacent to the first end of the bench means to move in a generally vertical arc during the operation of the device. A carriage means is disposed below the bench means for supporting the second end of the bench means on the platform means. A first exercise bar is also included, along with a first flexible means having a first end, a second end, and a middle portion. The first end of the flexible means is coupled to the first exercise bar means. The second end of the first flexible means includes a coupling means for coupling the second end to a member on the device disposed on a level generally no higher than the upper surface of the bench means.

In a preferred embodiment of the present invention, a second exercise bar means is pivotally mounted adjacent to the second end of the bench means, the second end of the first flexible means is coupled to the second exercise bar means, and an exercise bar support means is provided for supporting the first exercise bar means when the first exercise bar means is in a rest position.

Additionally, in a preferred embodiment, an upstanding bench support member is disposed adjacent to the first end of the frame means and extends generally between the first end of the frame means and the first end of the bench means for supporting the first end of the bench means in a spaced relation to the frame means. One end of the bench support means is pivotally coupled to either the frame or the bench, and the other end of the bench means is fixedly coupled to the other of the frame and bench, so that the operative coupling between the bench and frame is a pivotal coupling to permit the second end of the bench means to move in a generally vertical arc during the operation of the device.

One feature of the present invention is that the flexible cable to which the exercise bar is coupled is anchored on the device at a level generally below the upper surface of the bench. This feature has the advantage of obviating the need for any "overhead"structures placed above the bench on the device, thereby permitting a device to be manufactured which is more compact, is less bulky, requires fewer parts, and is less expensive to manufacture.

It is also a feature of a preferred embodiment of the present invention that a single set of flexible cables is provided which are coupled at one end to the first exercise bar, and at the other end to a second exercise bar; and that an exercise bar support is provided for supporting the first exercise bar when the first exercise bar is in the rest position. This feature permits the second exercise bar to serve as an anchor for the flexible cables when the first exercise bar is being used, and permits the first exercise bar and support to serve as an anchor for the flexible cable when the second exercise bar is being used. This feature has the advantage of permitting the user to use both exercise bars without being forced to connect or disconnect any cables, thus minimizing the interruptions to the user's exercise routine. A further advantage of this feature is that it obviates the need for second and third sets of cables, and thus reduces the number parts required for the device.

A further feature of the present invention is that the first end of the frame and bench are pivotally coupled together to permit the second end of the bench to move in a vertical arc during use, in response to the movement of a vertical arc of the platform disposed under the second end of the bench. This featured arrangement has the advantage of providing a device that permits the user to lift his own weight with a device which has fewer parts, and is less cumbersome than some prior known devices. As can be appreciated, this reduction in the number of parts (1) enables the device to be manufactured (and hence sold) less expensively than some known prior art devices; and (2) increases the reliability of the devices by reducing the number of parts which have the potential to breakdown or wear out.

Additional features and advantages of the invention will become apparent to those skilled in the art upon consideration of the following detailed description of a preferred embodiment exemplifying the best mode of carrying out the invention as perceived presently. The detailed description particularly refers to the accompanying figures in which:

BRIEF DESCRIPTION OF THE DRAWINGS

FIG. 5 is a side view of the present invention showing a user performing a "bench press" exercise;

FIG. 6 is a side view of the present invention showing a user performing a "bench press" exercise;

FIG. 7 is side view of the present invention showing a user performing a "leg extension" exercise;

FIG. 8 is a side view of the present invention showing a user performing a "leg extension" exercise;

DETAILED DESCRIPTION OF THE INVENTION

Figure 1:
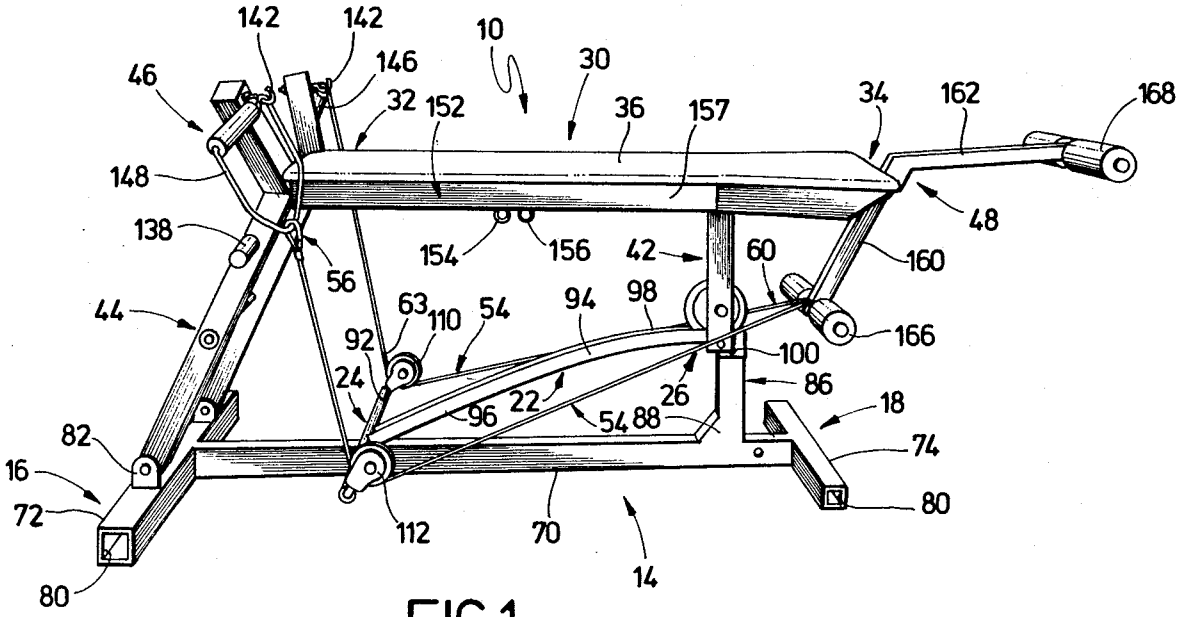
FIG. 1 is a side view of the present invention.
Figure 2:
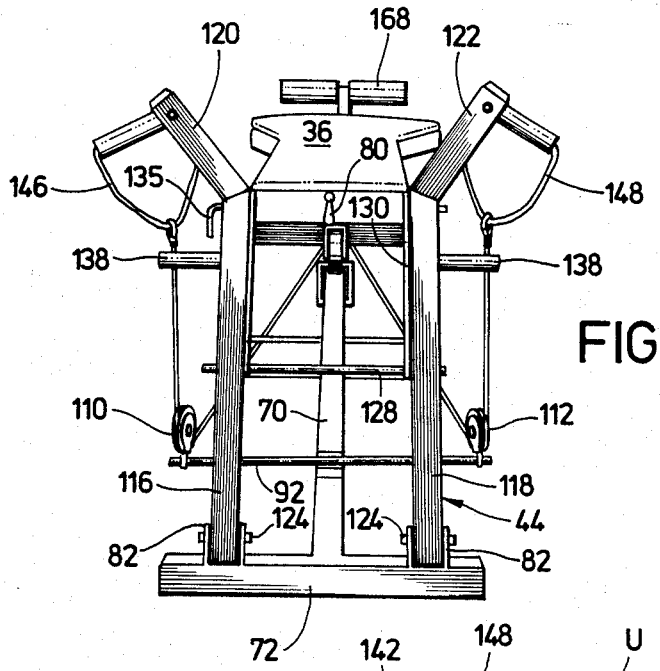
FIG. 2 is an end view of the present invention.
Figure 3:
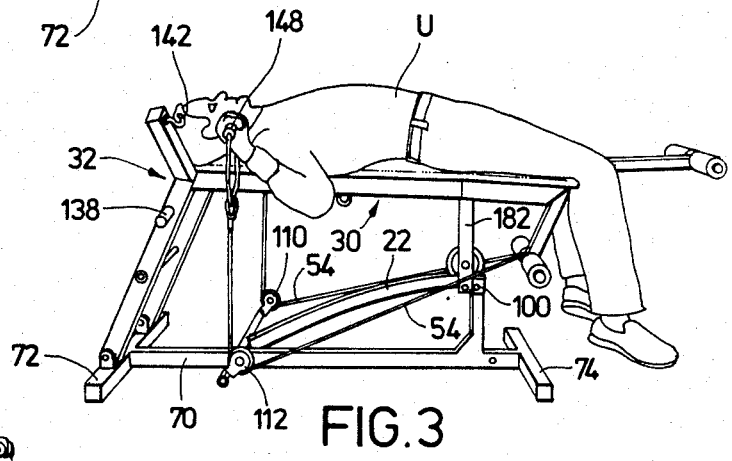
FIG. 3 is a side view of the present invention; showing a user performing a "bench press" exercise on the device.

Referring now to figures 1–3, the exercising device 10 of the present invention includes a frame means 14 having a first end 16 and second end 18. A platform means 22 includes a first end 24 and a second end 26. The second end 26 of the platform 22 is pivotally mounted adjacent to the second end 18 of the frame 14 to permit the first end 24 of the platform 22 to move in a generally vertical arc during the operation of the device 10. A bench means 30 is provided which has a first end 32, a second end 34 and an upper surface 36. The first end 32 of the bench 30 is pivotally mounted to the frame 14 adjacent to the first end 16 of the frame 14 to permit the second end 34 of the bench 30 move in a generally vertical arc during the operation of the device 10. A carriage means 42 is disposed below the bench 30 for supporting the second end 34 of the bench 30 on the platform 22.

A first exercise bar means 46 and a second exercise bar means 48 are provided for enabling the user to perform exercises. The second exercise bar 48 is pivotally coupled to the second end 34 of the bench 30. In the device 10 shown in the drawings, the second exercise bar 48 is a "leg lift" type exercise bar.

A first flexible cable means 54 includes a first end 56, a second end 60 and a middle portion 63. The first end 56 is coupled to the first exercise bar 46. The second end 60 is coupled to a portion of the device 10, such as the second exercise bar 48, which is disposed generally at a level no higher than the upper surface 36 of the bench 30. The middle portion 63 of the first flexible cable 54 passes around the platform 22, and is operatively coupled thereto.

As best shown in FIGS. 1 and 2, the frame 14 includes a longitudinally extending base member 70. A first laterally extending base member 72 is disposed in a generally perpendicular relation to the longitudinally extending base member 70, at the first end 16 of the frame 14. A second laterally extending base member 74 is disposed generally perpendicular to the longitudinally extending base member 70, at the second end 18 of the frame 14. Preferably, each of the base members 70, 72 and 74 are constructed of tube steel having a rectangular cross section. For example, in one model of the device 10, the cross sectional dimensions of each of the base members 70, 72 and 74, is approximately 2 inches (5.08 cm) in height, and 2 inches (5.08 cm) in width. In this model of the device 10, the length of the longitudinally extending base member is approximately 47.5 inches (120.65 cm); the length of the first laterally extending base member 72 is approximately 21 inches (53.34 cm); and the length of the second laterally extending member is approximately 21 inches (53.34 cm).

Preferably, a rectangular plastic end cap (not shown) can be inserted in the openings 80 at the ends of the lateral base members 72 and 74.

A pair of upwardly opening U-Channels 82 are welded to the upper surface of the first laterally extending base member 72, for receiving the lower ends of the upstanding bench support member 44.

An upstanding frame member 86, is welded, or otherwise fixedly attached to the upper surface of the longitudinally extending base member 70, adjacent to the second end 18 of the frame 14. The upstanding frame member 86 extends upwardly from the upper surface of the longitudinally extending base member 70, approximately 10 inches 25.4 cm) to support the second end 26 of the platform 22 in a spaced relation to the longitudinally extending base member 70. The upstanding frame member 86 can be constructed of tube steel having a rectangular oross seotion, similar to the tube steel from which the base members 70, 72 and 74 are constructed. Alternately, the upstanding frame member 86 can be constructed from a U-shaped channel steel member. The lower end 88 of the upstanding frame member 86 has an enlarged cross sectional area to increase stability.

The platform means 22 is generally T-shaped, and includes a laterally extending platform member 92 and an arcuate, longitudinally extending platform member 94. The longitudinally extending platform member 94 is generally co-planar with the longitudinally extending base member 70, with both the longitudinally extending platform member 94 and base member 70 occupying the same vertical plane.

The arc formed by the longitudinally extending platform member 94 is such that the portion 96 of the longitudinally extending platform member 94 adjacent to the first end 24 of the platform means 22, is at a relatively steeper incline (and hence a greater vertical orientation) than the relatively less inclined (and hence relatively more horizontal) portion 98 of the longitudinally extending platform member 94 adjacent to the second end 26 of the platform 22.

A pivot pin 100 extends through the longitudinally extending platform member 94, adjacent to the second end thereof, and through the upstanding frame member 86, near the top thereof, to pivotally connect the second end 26 of the platform means 22 to the frame means 14. This pivotal connection between the longitudinally extending platform member 94 and the upstanding frame member 86, permits the first end 24 of the platform 22 (including laterally extending platform member 92) to move in a generally vertical arc during the operation of the device 10.

A pair of pulleys 110 and 112 are swivelably mounted by swivel brackets to the ends of the laterally extending platform member 92, for receiving the middle portion 63 of the first flexible cable 54.

The upstanding bench support member 44 is provided for maintaining the first end 32 of the bench 30 in a spaced, vertical relation to the first end 16 of the frame 14, and for pivotally coupling the first end 32 of the bench 30 to the first end 16 of the frame 14. The upstanding bench support member 44 includes a first upstanding support rail 116 and a second upstanding support rail 118. The lower portions of the first and second upstanding support rails 116, 118 are generally parallel. Each of the first and second upstanding support rails 116, 118 includes an outwardly flared upper portion 120 and 122, respectively. The lower ends of each of the first and second upstanding support rails 116, 118 are pivotally coupled to the upwardly opening U-Channels 82 of the first laterally extending base member 72 by pivot pins 124. A cross brace 128 extends between the first and second upstanding support rails 116, 118 to maintain the first and second upstanding support rails 116, 118 in their proper spaced, parallel relation.

Figure 11:
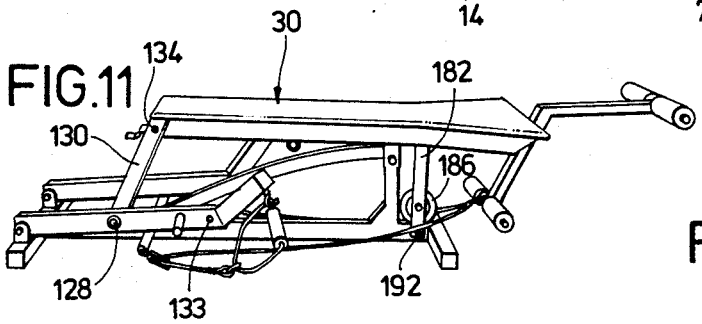
FIG. 11 is a side view of the present invention in a fully folded position.
Figure 13:
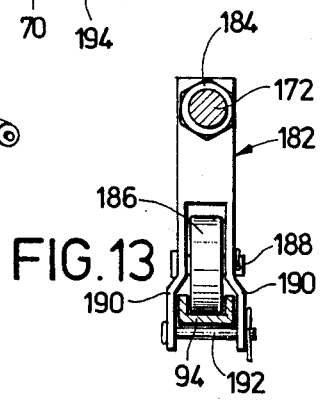
FIG. 13 is a sectional view taken along lines 13—13 of FIG. 12.

As best shown in FIG. 11, the cross brace 128 also extends through the lower end of the vertically extending support 130 mounted to the first end 32 of the bench 30 for supporting the bench 30. A pair of apertures 133 are formed in the top of the lower parallel portions of each of the first and second upstanding support rails 116, 118, to receive a pin 135 which passes through aperture 134 formed adjacent to the top end of the vertically extending support 130 of the bench 30. This two point connection effected by cross brace 128 and pin 135, fixedly couples the first end 32 of the bench 30 to the upstanding bench support member 44, so that the only pivot point between the bench 30 and the frame 14 is the pivotal coupling between pivot pins 124 and the U-shaped channels 82. Through this connection, the bench 30 and bench support member 44 maintain a fixed relation, relative to each other, while being pivotable about pivot pins 124 during the operation of the device 10.

Alternately, it will be appreciated that another means for accomplishing this pivotal connection between the bench 30 and the frame 14 is to remove the generally vertically extending support 130 from the bench, and fixedly couple (such as by welding) the lower ends of the upstanding bench support member 44 to the U-channels 82. Alternately, the U-channels 82 could be removed, and the bottom surfaces of the upstanding support rails 116 and 118 could be welded directly to the upper surface of the first laterally extending base member 72. As will be appreciated, this arrangement would cause the bench 30 to pivot about pin 135, and would cause the upstanding bench support 44 to remain stationary during the operation of the device 10.

Figure 9:
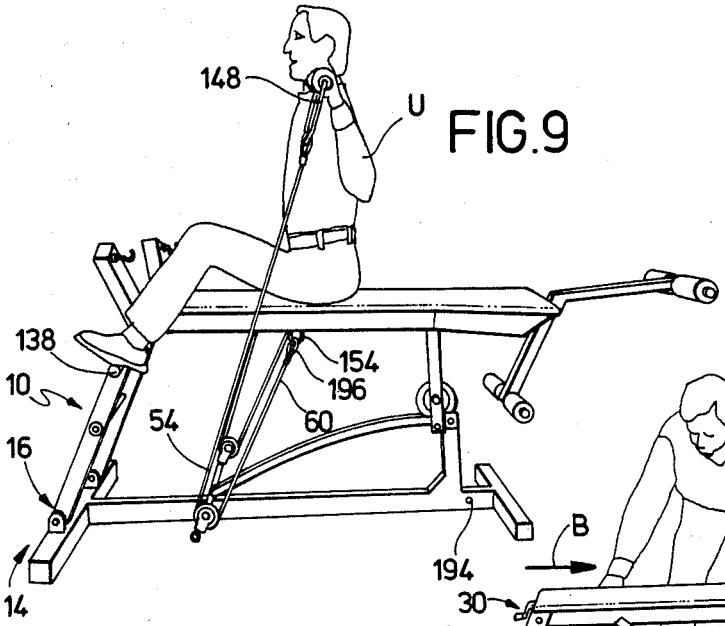
FIG. 9 is a side view of the present invention showing a user performing a "military press" exercise.

A pair of laterally extending leg or foot supports 138, extend laterally outwardly from the first and second upstanding support rails 116, 118 respectively. The foot supports 138 provide a place for the user to place his feet when performing a 'military press' type of exercise, such as is shown in FIG. 9.

Referring back primarily to FIGS. 1 and 2, the outwardly flared portions 120, 122 of the respective first and second upstanding support rails 116 and 118 are positioned to extend above and outwardly from the upper surface 36 of the bench 30. An exercise bar support means, such as hangers 42, are mounted adjacent to the tops of the outwardly flared portions 120 and 122 for supporting the first exercise bar 46, which in this embodiment comprises first and second stirrup-like handles 146, 148 respectively.

Figure 12:
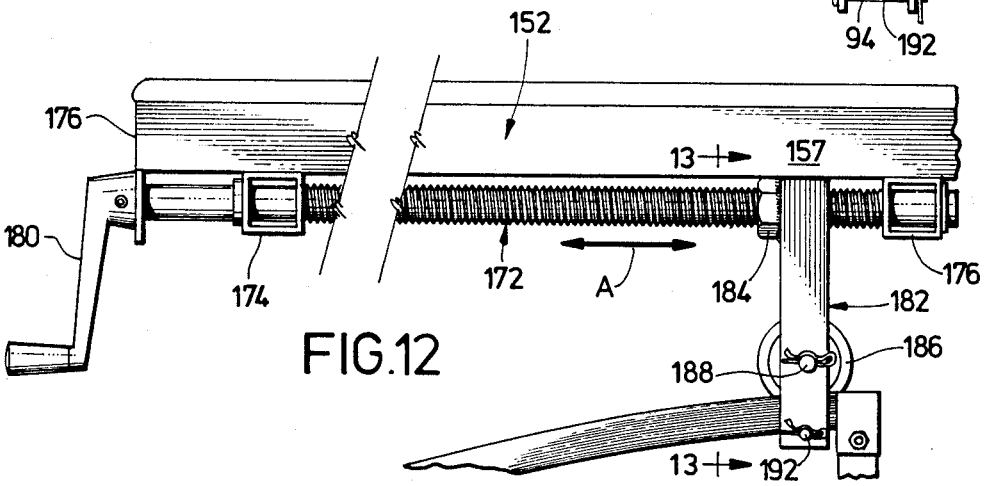
FIG. 12 is a side, sectional view of the adjustment means of the present invention.

The bench 30 includes a cushioned upper surface 36 which is supported above a bench frame 152; The bench frame 152 includes a pair of side rails, such as side rail 157, disposed along the sides of the bench, and a pair of end rails such as end rail 176 (FIG.12) disposed along each end of the bench 30. An eye-bolt 154, 156 is connected to each of the side rails 157 of the bench frame 152. The eye-bolts 154, 156 serve as an anchor to which the second end 60 of the first flexible cable 54 can be coupled, to operatively couple the second end 60 of the first flexible cable 54 to the bench 30, such as is shown in FIG. 9.

The second exercise bar 48 is shown in the drawings as being an angled, leg exercise bar having a first, or lower leg 160, which is fixedly coupled to, and disposed at an obtuse angle from a second, or upper leg 162. A first pair of body engaging pads 166 extend transversely from the bottom of the first leg 160, and a second pair of body engaging pads 168 extend transversely from the end of upper leg 162. The first and second pair of body engaging pads 166, 168 can be engaged by the user's body parts (such as the user's instep or heel) to move the second exercise bar 48 during an exercise routine. A pivot pin arrangement (not shown) pivotally couples the second exercise bar 48 to the second end 34 of the bench, to permit the second exercise bar 48 to move in a generally vertical arc, about a generally horizontal axis during an exercise routine using the second exercise bar 48, such as is shown in FIGS. 7 and 8.

Referring now to FIGS. 1, 2, 12 and 13, the adjustable carriage means 42 supports the second end 34 of the bench 30 in a vertically spaced relation from the platform 22, and permits the user to vary the effective weight acted on by the user during an exercise cycle.

The carriage means 42 includes a threaded rod 172 which extends longitudinally underneath the bench 30, and is rotatably journaled to cross members 174, 175, and end rail 176 of the bench 30. The journaling between the threaded rod 172 and the cross members 174, 175 and end rail 176, permit the threaded rod 172 to rotate through the rotation of crank handle 180 without changing the longitudinal position of the threaded rod 172. A yolk 182 is threadedly engaged to the threaded rod 172 by bolt 184, which is welded onto the yolk 182. The yolk 182 extends generally downwardly from the threaded rod 172 and includes a wheel 186 rotatably journaled to the yolk 182 by axle 188. Yolk 182 and wheel 186 are cooperatively sized and positioned to place the upper surface 36 of the bench 30 in a generally horizontal orientation when the wheel 186 rests upon the upper surface of the longitudinally extending platform member 94.

The yolk 182 also includes a collar portion 190 which extends downwardly below the level of the longitudinally extending platform member 94. The collar portion 190 includes a transversely extending collar pin 192, which extends underneath the longitudinal platform member 94, to prevent the wheel 186 frame becoming disengaged from the upper surface of the longitudinally extending platform member 94.

As will be explained in more detail below, the threaded engagement between the threaded rod 172 and the bolt 184 of yolk 182, permits the user to vary the relative longitudinal position of the wheel 186 on the upper surface of the longitudinally extending platform member 94, in a direction indicated qenerally by arrow A. By positioning the yolk 182 in a longitudinal position relatively closer to the first end 24 of the platform 22, the user can increase the effective weight lifted, or otherwise acted on, during an exercise routine.

Figure 10:
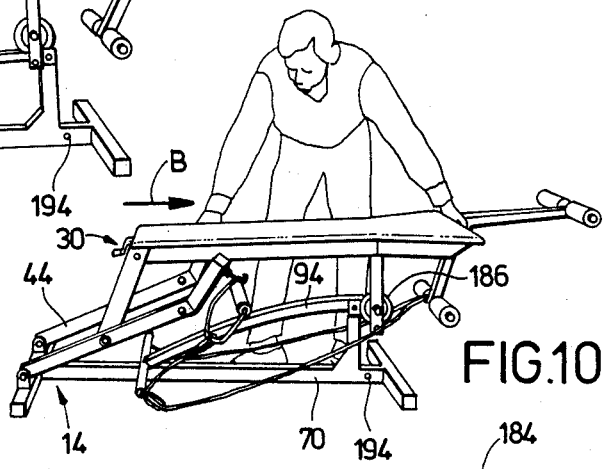
FIG. 10 is a side view of the present invention showing the device in a partially folded position.

As best shown in FIGS. 9, 10 and 11 the device 10 is foldable to provide a more compact structure when the device 10 is being moved or stored. To fold the device, pin 135 is removed from its engagement with the aperture 134 in the generally vertically extending support 130 of bench 30, and its engagement with aperture 133 of side rails 116, 118 of the bench support 44. Additionally, pin 192 is removed from its engagement with collar portion 192. The removal of these pins 135, 192 permits the bench 30 to be moved longitudinally in a direction indicated by arrow B of FIG. 10. This longitudinal movement causes the wheel 186 to become disengaged from the longitudinally extending platform member 94, and causes the upstanding bench support member 44 to pivot relative to both the frame 14, and the bench 30.

The bench 30 is moved longitudinally to the position shown generally in FIG. 11. Pin 192 of yolk 182 is then placed through aperture 194 in the longitudinally extending base member 70 of the frame means 14. The engagement of pin 192 in both yolk 182 and longitudinally extending base member 70, fixes the relative positions of the frame 14 and bench 30, and secures the frame 14 and bench 30 together to facilitate storage of the device 10. For example, when so secured, the device 10 can be stored on its end, thus reducing the amount of floor space required.

Figure 4:
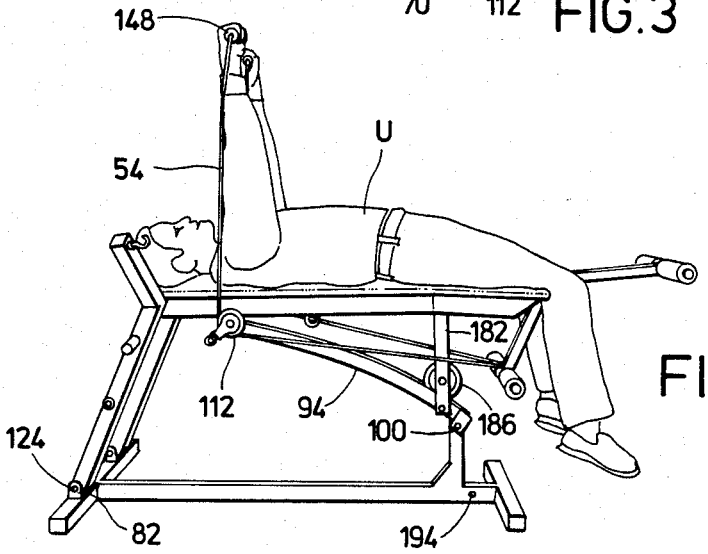
FIG. 4 is a side view of the present invention showing a user performing a "bench press" exercise.

The operation of the device 10 will now be explained:

Referring now to FIGS. 3 and 4, a user U is shown performing a bench press exercise on the device 10. In order to perform a bench press exercise, the user U lays on his back on the upper surface 36 of the bench 30, with his head disposed at the first end 32 of the bench 30, and with his feet dangling off of the second end 34 of the bench 30. The user U then removes the first and second handles 146, 148 from their respective engagements with the hangers 142.

The user U extends his arms vertically upwardly, as shown in FIG. 4 to perform the exercise. The movement of the handles 146, 148, results in movement of the pair of first flexible cables 54. Through the engagement between the flexible cable 54 and the pulleys 110, 112, the upward movement of the handles 146, 148, causes the first end 24 of the platform 22, to move upwardly in a generally vertical arc. The limit to which the first end 24 of the platform 22 can be moved upwardly is defined by the underside of the bench 30. As will be appreciated, the movement (such as from FIG. 4 to FIG. 3), of the user's U arms downwardly, causes the first end 24 of the platform means 22 to pivot about pivot pin 100, in a generally downwardly directed vertical arc. When the user U exercises by moving the first and second handles 146, 148, the second exercise bar 48 serves as an anchor for the flexible cable 54, through the coupling of the second end of the flexible 54 and the lower leg 160 of the second exercise bar 48.

As will be noted from a careful review of FIG. 3 and 4, the vertically upwardly movement of the second end 26 of the platform 22 causes the second end 34 of the bench 30 to pivot upwardly relative to the frame 14, about the axis of pivot pins 124. Thus, by lifting the platform 94, the user U lifts the bench 30. Hence, it will be appreciated that the weight acted on by the user U during his exercise routine comprises, at least in portion, the user's U own body weight.

FIGS. 5 and 6 are generally similar to FIG. 3 and 4, in that both sets of figures show a user U performing a bench press type exercise on the device. The primary difference between that which is shown in FIG. 5 and 6 is that FIG. 5 and 6 illustrate the user U performing an exercise on the device wherein the adjustment means feature of the carriage 42 has been adjusted, to cause the yolk 182 to be moved longitudinally in the direction indicated generally by arrow L (FIG. 5) from its position (shown in FIG. 3 and 4) adjacent to the second end 26 of the platform 22, to a position closer to the first and 24 of the platform 22. As shown in FIG. 5 and 6, the yolk 182 and wheel 186 are positioned about one third of the way toward the first end 24 of the platform 22.

The mechanical significance of this movement is that in the position shown in FIGS. 5 and 6, the yolk in 182 and wheel 186 are spaced at a greater distance from pivot pin 100 than the yolk 182 and wheel 186 are spaced from pivot pin 100 in the position shown in FIG. 3 and 4. As those familiar with the operation of fulcrums and levers will appreciate, this greater distance between the yolk 182 and the pivot pin 100 means that the user U will have to exert a greater degree of effort to lift his weight, (and the weight of the bench 30) when the yolk and wheel 186 are placed at a relatively greater distance from pivot pin 100. Additionally, FIG. 6, when the user's arms are in their fully extended position, and the yoke is moved away from the pivot pin 100, the second end 34 of the bench 30 is raised a greater distance than it is when the yolk 182 and wheel 186 are positioned closer to the pivot pin 100, as shown in FIG. 4. Thus, through the movement of the yolk 182 and wheel 186 in a longitudinal direction along platform means 22, the user can vary the effective weight against which he is acting during his exercise routine.

In FIGS. 7 and 8, the user U is shown performing a leg lift exercise on the device 10. To perform a leg lift exercise, the user sits on the second end 34 of the bench 30, with his legs dangling over the end of the bench 30. The user then engages the body engaging pads 166 of the lower leg portion 160 of the second exercise bar 48 with his shins. When performing exercises with the second exercise bar 48, the engagement between the handles 146, 148 and the exercise bar support member hangers 142, serves as an anchor for the pair of first flexible cables 54, to permit the movement of the second exercise bar 48 to cause the platform means 22 to move in a generally vertical arc.

FIG. 9 illustrates the user U performing a military press type of exercise. To perform a military press type of exercise, the user sits on the bench 30 facing the first end 16 of the frame 14. The user can place the soles of his feet on the foot supports 138 to use the foot supports 138 as a brace. The user then exercises by moving the first and second stirrup like handles 146, 148 upwardly over his head.

Due to the fact that, when in the sitting position, a greater "amount" of cable is required to permit the user to fully extend his arms over his head, the user U, should disengage the coupling means, such as snap shackle 196 at the second end 60 of the flexible cable 54, from its engagement with the second exercise bar 48. The user should then reconnect the snap shackles 196 to the eye bolts 154 disposed on the underside surface of the bench 30.

Although the invention has been described in detail with reference to certain preferred embodiments and specific examples, variations and modifications exists within the scope and spirit of the invention as described and as defined in the following claims.

What is claimed is:

1. A weightlifting exercising device of the type wherein at least a portion of the weight lifted includes the user's own weight, comprising (a) a frame means having a first end and a second end, (b) a platform means having a first end and a second end, the second end of the platform means being pivotally mounted adjacent to the second end of the frame means to permit the first end of the platform means to move in a generally vertical arc during the operation of the device.

(c) a bench means having a first end disposed adjacent to the first end of the frame means, a second end disposed adjacent to the second end of the frame means and the second end of the platform means, and an upper surface, the first end of the bench means being pivotally mounted to the frame means adjacent to the first end of the bench means to permit the second end to move in a generally vertical arc during the operation of the device, (d) a carriage means disposed below the bench means for supporting the second end of the bench means on the platform means, (e) a first exercise bar means, and (f) a first flexible means having a first end, a second end, and a middle portion, the first end being coupled to the first exercise bar means, the second end including a coupling means for coupling the second end to a member on the device disposed at a level generally below the upper surface of the bench means, and the middle portion passing around the platform means.

2. The invention of claim 1 wherein the frame means includes a longitudinally extending base member, and an upstanding member disposed adjacent the second end of the frame means for supporting the second end of the platform means in a spaced relation to said longitudinally extending base member.

3. The invention of claim 1 wherein the platform means includes a unitary, longitudinally extending platform member disposed generally co-planar with the longitudinally extending base member of the frame means.

4. The invention of claim 1 wherein the platform means is generally T-shaped and includes a longitudinally extending platform member, and a laterally extending platform member disposed at the first end of the platform means.

5. The invention of claim 4 further comprising a pulley means swivelably mounted to the laterally extending platform member, and wherein the middle portion of the first flexible means passes around the pulley means.

6. The invention of claim 1 further comprising an upstanding bench support member disposed adjacent to the first end of the frame means and extending generally between the first end of the frame means and the first end of the bench means for supporting the first end of the bench means in a spaced relation to the frame means, the bench support member including an upper portion fixedly coupled to the bench means and a lower portion pivotally coupled to the frame means, wherein said pivotal coupling between the upstanding bench support member and said frame means pivotally couples the bench means to the frame means to permit the second end of the bench means to move in a generally vertical arc during the operation of the device.

7. The invention of claim 1 further comprising an upstanding bench support member disposed adjacent to the first end of the frame means and extending generally between the first end of the frame means and the first end of the bench means for supporting the first end of the bench means in a spaced relation to the frame means, the bench support member including an upper portion pivotally coupled to the bench means, and a lower portion fixedly coupled to the frame means, wherein said pivotal coupling between the upstanding bench support member and said frame means pivotally couples the bench means to the frame means to permit the second end of the bench means to move in a generally vertical arc during the operation of the device.

8. The invention of claim 1 further comprising an upstanding bench support member disposed adjacent to the first end of the frame means and extending generally between the first end of the frame means and the first end of the bench means for supporting the first end of the bench means in a spaced relation to the frame means, the upstanding bench support member being fixedly coupled to one of the frame means and bench means, and pivotally coupled to the other of the frame means and bench means to permit the second end of the bench means to move in a generally vertical arc during the operation of the device.

9. The invention of claim 8 wherein the upstanding bench support member includes a lower portion and an upper portion, the upper portion including an outwardly flared segment, further comprising an exercise bar support means mounted to the outwardly flared portion of the upstanding bench support member for supporting said first exercise bar means.

10. The invention of claim 9 further comprising an outwardly extending foot rest means disposed on said upstanding bench support member.

11. The invention of claim 1 further comprising a second exercise bar pivotally mounted to the bench means adjacent to the second end of the bench means, the second exercise bar including a first portion, and a second portion disposed at an angle from the first portion, the first portion of said second exercise bar comprising said member on the device to which the second end of the first flexible means is coupled.

12. The invention of claim 11 wherein said first exercise bar comprises a pair of handles, and said second exercise bar comprises a leg lift exercise bar.

13. The invention of claim 1 wherein said carriage means includes a yoke, a wheel means rotatably mounted to the yoke and restable on the platform means for supporting the second end of the bench means in a spaced relation to the platform means.

14. The invention of claim 13 wherein said platform means includes a longitudinally extending platform member having an underside surface and, said yoke includes a collar portion having a collar portion element deposed underneath the longitudinally extending platform member to prevent the wheel means from becoming disengaged from the platform means.

15. The invention of claim 1 wherein said first exercise bar means is disposed generally adjacent to said first end of the bench means, further comprising a second exercise bar disposed adjacent to the second end of said bench means.

16. The invention of claim 15 further comprising an exercise bar support means for supporting the first exercise bar means, and wherein said second exercise bar comprises said member of the device to which said second end of the first flexible means is coupled.

wherein when the user operates the device by using the first exercise bar means, the second exercise bar means serves as an anchor for the first flexible means, and when the user operates the device by using the second exercise bar means, the exercise bar support means serves as an anchor for the first flexible means.

17. The invention of claim 1 further comprising an exercise bar support means for supporting the first exercise bar means, and wherein said first exercise bar is disposed generally adjacent to said first end of the frame means, said bench means comprises the member of the device to which said second end of the first flexible means is coupled, whereby when the user operates the device by using the first exercise bar means, the bench means serves as an anchor for the first flexible means.

18. A weight lifting exercise device of the type wherein at least a portion of the weight lifted includes the user's own weight comprising (a) a frame means having a first end and a second end, (b) a platform means having a first end and a second end, the second end of the platform means being pivotally mounted adjacent to the second end of the frame means to permit the first end of the platform means to move in a generally vertical arc, (c) a bench means having a first end disposed adjacent to the first end of the frame means, and a second end disposed adjacent to the second end of the frame means, the first end of the bench means being pivotally coupled to the frame means to permit the second end of the bench means to move in a generally vertical arc, (d) a carriage means disposed below the bench means for supporting the second end of the bench means on the platform means, (e) a first exercise bar means disposed generally adjacent to the first end of the bench means, (f) an exercise bar support means for supporting the first exercise bar means when the first exercise bar means is in a rest position.

(g) a second exercise bar means pivotally mounted adjacent to the second end of the bench means, and (h) a first flexible means having a first end, a second end and a middle portion, the first end being coupled to the first exercise bar means, the second end being coupled to the second exercise bar means, and the middle portion passing around said platform means, wherein, when the user operates the device by using the first exercise bar means, the second exercise bar means serves as an anchor for the first flexible means, and when the user operates the device by using the second exercise bar means, the exercise bar support means serves as an anchor for the first flexible means.

* * * * *